US006075436A

United States Patent [19]

Hsu

[11] Patent Number: 6,075,436

[45] Date of Patent: Jun. 13, 2000

[54] CIRCUIT BREAKER ASSEMBLY

[76] Inventor: Cheng Chao Hsu, 1650, 8th Ave., #203, San Diego, Calif. 92101

[21] Appl. No.: 09/314,274

[22] Filed: May 18, 1999

[51] Int. Cl.[7] ..... H01H 37/52; H01H 37/32

[52] U.S. Cl. ..... 337/363; 337/318; 337/333; 337/365

[58] Field of Search ..... 337/312, 363, 337/77, 78, 100–102, 107, 141, 333, 370, 377, 381, 318, 365, 390, 89, 131, 362

[56] References Cited

U.S. PATENT DOCUMENTS

| | | | |
|---|---|---|---|
| 1,996,720 | 4/1935 | Getchell | 337/107 |
| 2,237,262 | 4/1941 | Miller | 337/70 |
| 2,302,924 | 11/1942 | Valverde | 236/68 R |
| 2,605,339 | 7/1952 | Connolly | 340/870.09 |
| 2,635,156 | 4/1953 | Welter | 337/141 |
| 2,763,750 | 9/1956 | Adams et al. | 337/78 |
| 3,066,206 | 11/1962 | Dales | 337/372 |
| 3,087,146 | 4/1963 | Boudouris | 340/332 |
| 3,107,281 | 10/1963 | Tufts | 200/38 D |
| 3,258,647 | 6/1966 | Clark | 361/105 |
| 3,458,675 | 7/1969 | Del Gaudio | 200/61.64 |
| 3,569,887 | 3/1971 | Brown | 337/77 |
| 4,345,233 | 8/1982 | Matthies | 337/75 |
| 4,347,709 | 9/1982 | Wu et al. | 62/140 |
| 4,363,016 | 12/1982 | Unger | 337/56 |
| 4,528,538 | 7/1985 | Andersen | 337/43 |
| 5,012,495 | 4/1991 | Munroe et al. | 337/3 |
| 5,079,530 | 1/1992 | Tsuchiyama | 335/17 |
| 5,262,748 | 11/1993 | Tsung-Mou | 337/66 |
| 5,402,099 | 3/1995 | Ballard et al. | 337/298 |
| 5,453,725 | 9/1995 | You et al. | 337/68 |
| 5,539,371 | 7/1996 | Yu | 337/66 |
| 5,694,106 | 12/1997 | Wang | 337/79 |
| 5,892,428 | 4/1999 | Hsu | 337/363 |

FOREIGN PATENT DOCUMENTS

| | | | |
|---|---|---|---|
| 8-124471 | 5/1996 | Japan | H01H 71/12 |

*Primary Examiner*—Leo P. Picard
*Assistant Examiner*—Anatoly Vortman
*Attorney, Agent, or Firm*—Raymond Y. Chan; David and Raymond

[57] ABSTRACT

A circuit breaker assembly, which is responsive to both current overload and thermal overheat or over-cold, includes a circuit breaker switch containing a current release device arranged in a housing to be responsive to a current overload and operative to permit a respective contact spring to move a corresponding movable contact away from a fixed contact upon the occurrence of a current overload and independently of the position of a switching rocker; and a thermal release actuator received in the housing for can automatically providing an actuating action to operate another respective contact spring to move another corresponding movable contact away from another fixed contact when a temperature of a predetermined surrounding zone is overheated or over-cold. The circuit breaker further includes at least a thermal detector disposed within the surrounding zone for breaking a current flowing therethrough when a temperature therearound is overheated or over-cold that reaches a predetermined temperature; and a connecting circuit for electrically connecting the thermal detector in parallel with the circuit breaker switch.

20 Claims, 6 Drawing Sheets

CIRCUIT BREAKER ASSEMBLY

BACKGROUND OF THE PRESENT INVENTION

1. Field of the Invention

The present invention relates to a circuit breaker, and more particular to a circuit breaker assembly responsive to both current overload and thermal overheat/over-cold, which can switch off automatically not only in dependence on the occurrence of an excess current, but also when the temperature of a predetermined surrounding zone is overheated or over-cooled.

2. Description of Related Art

Most electrical appliances break down because of overheating. Overheating of an appliance or a circuit frequently causes fire or electrical shock. In order to provide a kind of protection, most houseware appliances use a fuse to prevent the overheating of the electrical wires. For the building circuitry, the bi-metal type circuit breakers are the most common devices installed in the control panels to prevent the overheating of the electrical wiring.

Circuit breakers, such as that disclosed in U.S. Pat. No. 4,167,720, are generally used to protect electrical circuits by automatically switching off on the occurrence of any excess of current. In the other words, those conventional circuit breakers are substantially the electrical current protectors to prevent overheating of the electrical wiring due to the excess current or overloaded current.

However, the surrounding around the electrical appliance connected to the electrical circuit has nothing to protect against overheating or over-cooling. It will also create a danger of fire or breaking down situation. For examples, a halogen floor lamp would generate a great amount of heat therearound that has a high risk of burning stuff like the curtain around; a heater is an appliance for generating heat. However, the user can only control the heat by setting the power output or the timer control. It is relatively expensive and difficult to control the heater according to the actual temperature around the heater.

In fact, every electrical appliance that generates heat needs a thermal guard to prevent the surrounding being overheated or over-cooled. It would be a remarkable matter if the circuit breaker can also switch off the circuit if the monitoring surrounding is too hot or too cold. It not only can prolong the service life of the electrical appliances, but also can help the user to avoid unreasonable hazard or damages.

SUMMARY OF THE PRESENT INVENTION

It is a main object of the present invention to provide a circuit breaker assembly which can switch off automatically not only in dependence on the occurrence of an excess current, but also when the temperature of a predetermined surrounding zone is overheated or over-cooled.

It is another object of the present invention to provide a circuit breaker assembly responsive to both the current overload and thermal overheat or over-cold, which has a relatively economic structure and is efficient in operation.

It is another object of the present invention to provide a circuit breaker assembly responsive to both the current overload and thermal overheat or over-cold, which comprises a thermal release actuator and more than one thermal detectors parallelly connected with the thermal release actuator of the circuit breaker switch.

In order to accomplish to above objects, the present invention provides a circuit breaker assembly, which is responsive to both current overload and thermal overheat or over-cold, comprising:

a circuit breaker switch which comprises a housing; a pair of contact springs each affixing at one end in the housing and carrying a movable contact at a free end thereof, and biased to urge the movable contact away from an associated fixed contact; a switching rocker pivotally mounted in the housing to selectively move between a breaker closing position so as to act on the contact spring to urge the movable contact toward the fixed contact and a breaker opening position in which the rocker permits the contact spring to move the movable contact away from the fixed contact, the switching rocker being mounted to pivot about an axis which extends approximately perpendicular to the length of the contact spring; a current release device arranged in the housing to be responsive to a current overload and operative to permit the contact spring to move the movable contact away from the fixed contact upon the occurrence of a current overload and independently of the position of the switching rocker; and a thermal release actuator received in the housing for automatically providing an actuating action to operate the contact spring to move the movable contact away from the fixed contact when a predetermined surrounding zone is overheated or over-cooled at least a thermal detector disposed within the surrounding zone for breaking a current flowing therethrough when a temperature therearound is reaches a predetermined temperature; and a connecting circuit to electrically connect the thermal detector in parallel with the thermal release actuator.

In a preferred embodiment of the present invention, the thermal release actuator comprises an actuating piece made of thermostatic metal strip, a conducting terminal piece connected to the actuating piece, an insulating sleeve covering a portion of the actuating piece, and an electrical heat wire wrapping around the insulating sleeve which has one end electrically connected to the actuating piece.

Also, the thermal detector comprises a first contact member made of electrical conducting material, a second contact member made of thermostatic metal and an insulating connector connected between a connecting end of the second contact member and the first contact member. The second contact member has a contact end normally pressed against and remained in contact with the first contact member. The contact end of the second contact member would bend away from the first contact member so as to render the first and second contact members becoming separated when the temperature around the thermal detector reaches a predetermined temperature. However, when the temperature around the thermal detector drops down to normal, the first and second contact members will automatically reset to the contacting condition again.

Moreover, the connecting circuit comprises an input terminal, an output terminal, a first connecting wire electrically connected the thermal detector between the input and output terminals, and a second connecting wire which is extended between the input and output terminals in parallel with the first connecting wire so as to electrically connect the circuit breaker switch between the input and output terminals.

When the second contact member is normally remained in contact with the first contact member, more than 50% of a main current input at the input terminal of the connecting circuit flows through the thermal detector and less than 50% of the main current flows through the circuit breaker switch.

However, when the second contact member bends to separate the first contact member due to overheating or over-cooling around the thermal detector, 100% of the main current flows to circuit breaker switch via the thermal release actuator thereof. The heat wire wrapped around the actuating piece generates heat to increase the temperature around the actuating piece. When the temperature around the actuating piece increases to a predetermined extent, the actuating piece bends so as to provide an actuating action to activate the circuit breaker switch to switch off to cut the electric supply.

DETAILED DESCRIPTION OF THE PREFERRED EMBODIMENT

Referring to FIGS. 1 to 5, according to a preferred embodiment of the present invention, a circuit breaker assembly which is responsive to both current overload and thermal overheat or over-cold is illustrated. The circuit breaker assembly comprises a circuit breaker switch 10, at least a thermal detector 20 and a connecting circuit 30.

Figure 1:
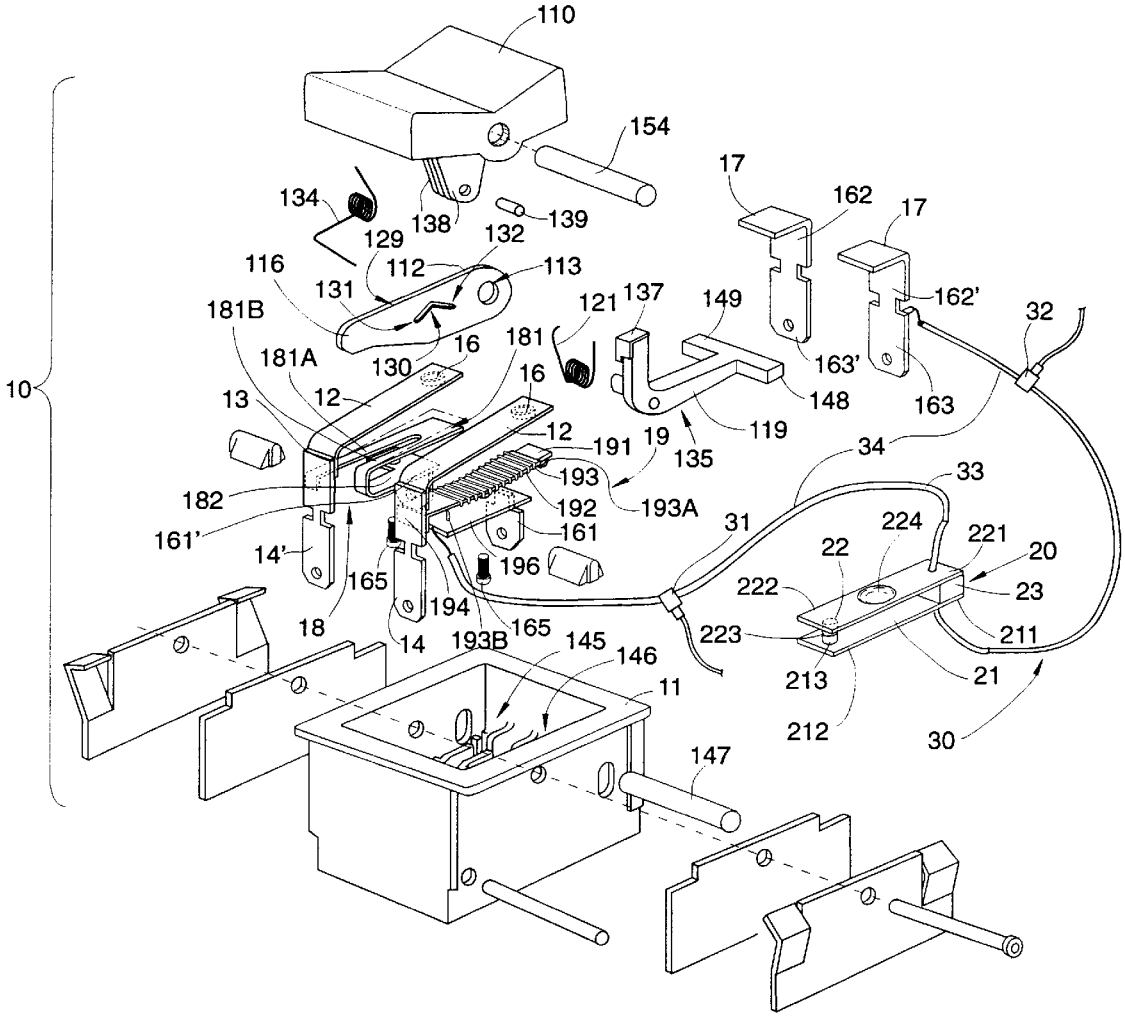
FIG. 1 is an exploded perspective view of a two-pole circuit breaker assembly according to a preferred embodiment of the present invention.
Figure 2:
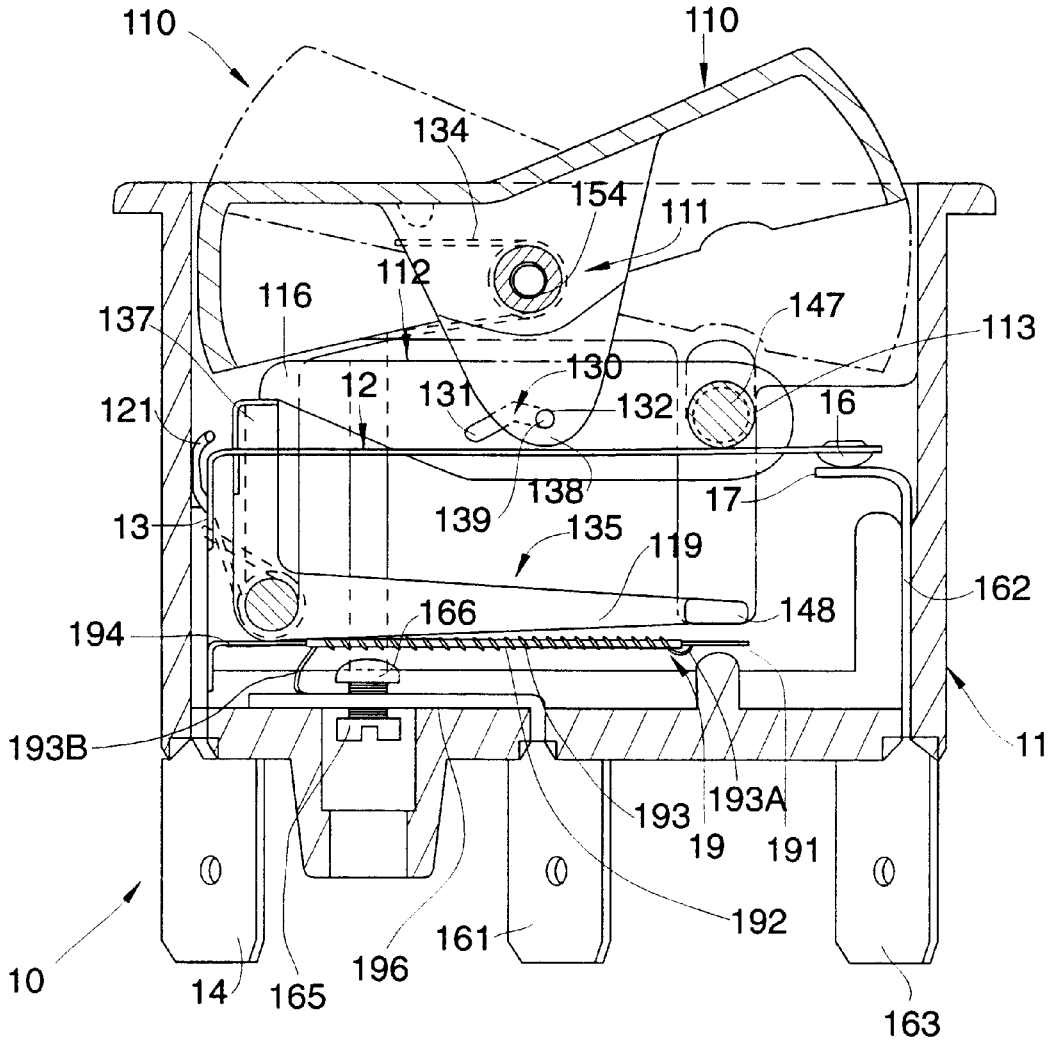
FIG. 2 is a sectional side view of the circuit breaker switch according to the above preferred embodiment of the present invention.
Figure 3:
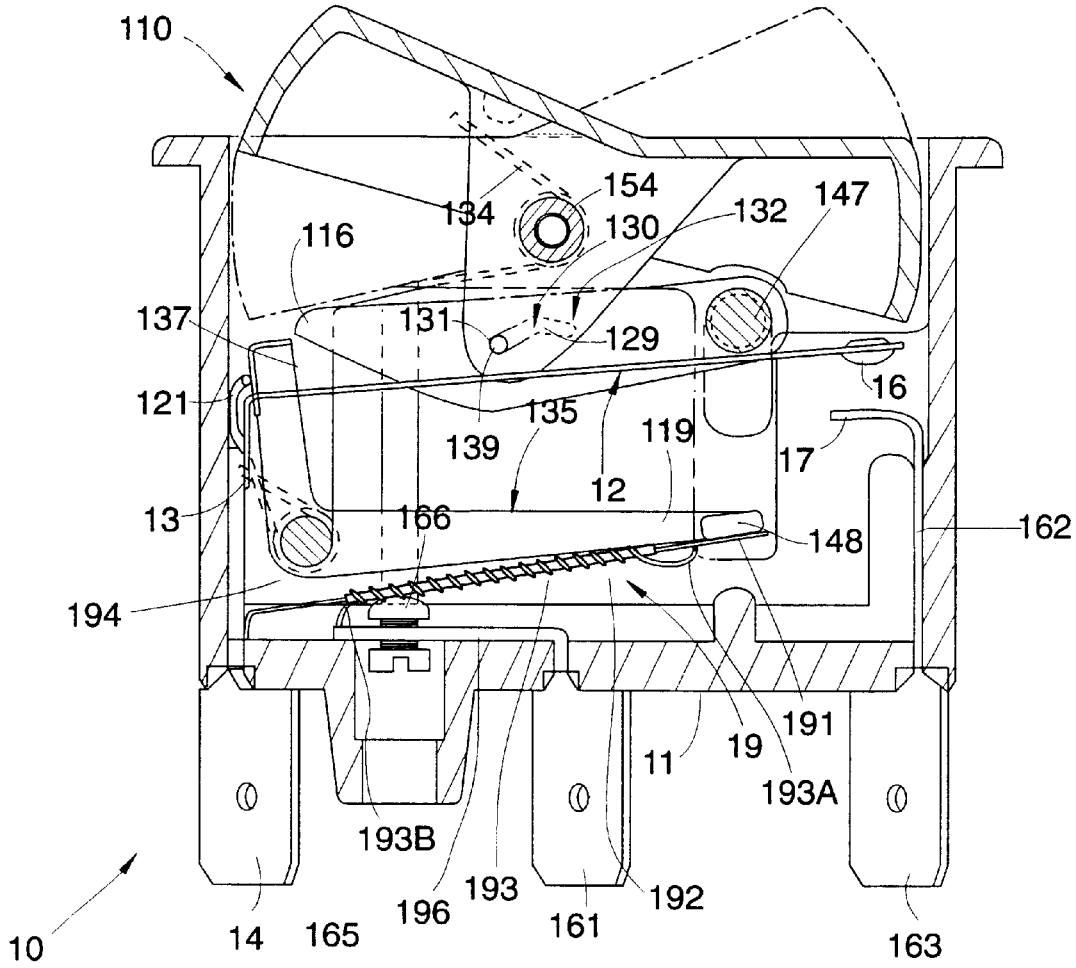
FIG. 3 is a sectional side view of the circuit breaker switch, in switched off position, where switch-off occurred as a result of a thermal overheating or over-cooling, according to the above preferred embodiment of the present invention.

As shown in FIGS. 1 to 3, the circuit breaker switch 10 comprises a housing 11; a pair of contact springs 12 each affixing at one end in the housing 11 and carrying a movable contact 16 at a free end thereof, and biased to urge the movable contact 16 away from an associated fixed contact 17; a switching rocker 110 pivotally mounted in the housing 11 to selectively move between a breaker closing position so as to act on the contact spring 12 to urge the movable contact 16 toward the fixed contact 17 and a breaker opening position in which the switching rocker 110 permits the contact spring 12 to move the movable contact 16 away from the fixed contact 17, the switching rocker 110 being mounted to pivot about an axis 154 which extends approximately perpendicular to the length of the contact spring 12; a current release device 18 arranged in the housing 11 to be responsive to a current overload and operative to permit the respective contact spring 12 to move the movable contact 16 thereof away from the corresponding fixed contact 17 upon the occurrence of a current overload and independently of the position of the switching rocker 110; and a thermal release actuator 19 received in the housing 11 to automatically provide an actuating action to operate the respective contact spring 12 to move the movable contact 16 thereof away from the corresponding fixed contact 17 when a predetermined surrounding zone is overheated or over-cooled.

According to the preferred embodiment of the present invention, a circuit breaker as disclosed in U.S. Pat. No. 4,167,720 is employed to, but not limited to, show the basic switching off function of a circuit breaker, wherein one of the two bi-metal mechanisms is substituted by the thermal release actuator 19 of the present invention to incorporate with the thermal detector 20 of the circuit breaker assembly of the present invention, as shown in FIGS. 1 to 3.

In other to better illustrate the features and functions of the present invention, the structure of the circuit breaker switch 10 according to the preferred embodiment, including the general conventional structure, is briefly described hereinafter.

As shown in FIGS. 1 to 3, a pin 139 is engaged in a guide groove 139 which is closed on all sides and defines the cam path. The guide groove 129 has a generally V shape and the peak 130 of the V, corresponding to projection 126, points toward the switching rocker 110. The branch 131 of the V, as shown in FIG. 1, which corresponds to detent recess 127, and which extends toward the detent end 116 of the latching lever 112, is longer than the branch 132, as shown in FIG. 1, of the V which corresponds to recess 124 and which extends toward the contact end 113 of lever 112.

The switching rocker 110 is under the influence of a resetting force which is produced by a torsion spring 134. A load arm 137 of an angular lever 135 extends approximately parallel to an adjacent lateral wall of housing 10. The resetting force acting on the load arm 137 in opposition to the pivoting direction is produced by the resetting spring 121 disposed effectively between the load arm 137 and the wall of housing 10.

An active end 122 of the switching rocker 110 is constituted by two parallel arms 138 which surround the latching lever 112 while resting against its sides and thus guiding it. Arms 138 form a mount for the pin 139 which engages in the guide groove 129 of the latching lever 112.

The latching lever 112 contacts the back of both contact springs 12 of the circuit breaker switch 10 by means of a shaft 147 which is made of electrical insulating material and projects on both sides into chambers 145, 146 in the area of its contact end 113 of the latching lever 112 and extends parallel to an axis 111 of the switching rocker 110.

A pair of first connecting lugs 14 project out of the housing 11 and are secured tightly in the housing 11 by being twisted. As shown in FIG. 1, the release device 18 comprises a bimetal strip 181 which is of U-shaped design and is fastened to a respective first connecting lug 14 via an end of one of its arms 181*a* while an end of another arm 181*b* of the U is angled and permanently conductively connected with a bimetal strip lead 182 that ends in a second connecting lug 161 which is also affixed to the wall of the housing 11 by twisting.

As shown in FIGS. 1 to 3, the thermal release actuator 19 comprises an actuating piece 191 made of thermostatic metal (bi-metal), an insulating sleeve 192 covering a front portion of the actuating piece 191, and an electrical heat wire 193 wrapping around the insulating sleeve 192, wherein the electric heat wire 193 has a first end 193A connected to the actuating piece 191 and a second end 193B connected to the second connecting lug 161 which has no structural connection with the first connecting lug 14 and the actuating piece 191. The insulating sleeve 192 acts as an insulating layer between the surface of the actuating piece 191 and the heat wire 193 to avoid electrical contact therebetween. A rear portion 194 of the actuating piece 191 is bent and perpendicularly fastened to the connecting lug 14.

Two fixed ends 13 of the two contact springs 12 are welded to the two first connecting lugs 14', 14 respectively to form a conductive connection therewith. Two fixed contacts 17 are permanently connected to a pair of contact terminals 162', 162 respectively, each of which forms a one-piece unit with a third connecting lug 163', 163 which is likewise fastened to the wall of housing 11 by twisting.

A power arm 119 of an angular lever 135, which is acted on by the bimetal strip 181 constituting overload responsive element and by the actuating piece 191 constituting temperature responsive element, extends approximately parallel to the contact spring 12 and/or to the latching lever 112. The power arm 119 of the angular lever 135 is provided at its free end with two bi-directionally projection protrusions 148, 149 which extent into the path of the displacement of the respective actuating piece 191 and the bimetal strip 181 respectively.

It should be mentioned that in the circuit breaker switch, the bimetal strip 181 can be matched in such a manner that deflection of the bimetal strip 181 in response to a current overload is sufficient to pivot the angular lever 135 and thus open both switch poles.

At each of the bimetal strip lead 182 and a horizontal lead 196 of the second connecting lug 161, there is provided an adjustment screw 165. The two adjustment screws 165 respectively press against the bimetal strip 182 and the horizontal lead 196 via two insulating members 166 (as shown in FIG. 1). Adjustment of screws 165 vary the bias of the bimetal strip 181 and the actuating piece 191 respectively and thus influences the release time of the device.

When the circuit breaker switch 10 is plugged into a breaker panel or other electrical power installation, each current path to be protected is connected in series. Thus, with referring to FIGS. 1, 4 and 5, current may flow via the second connecting lug 161, the heat wire 193, the actuating piece 191, the first connecting lug 14, the contact spring 12, the contacts 16, 17, the lead 162, and the third connecting lug 163.

Figure 4:
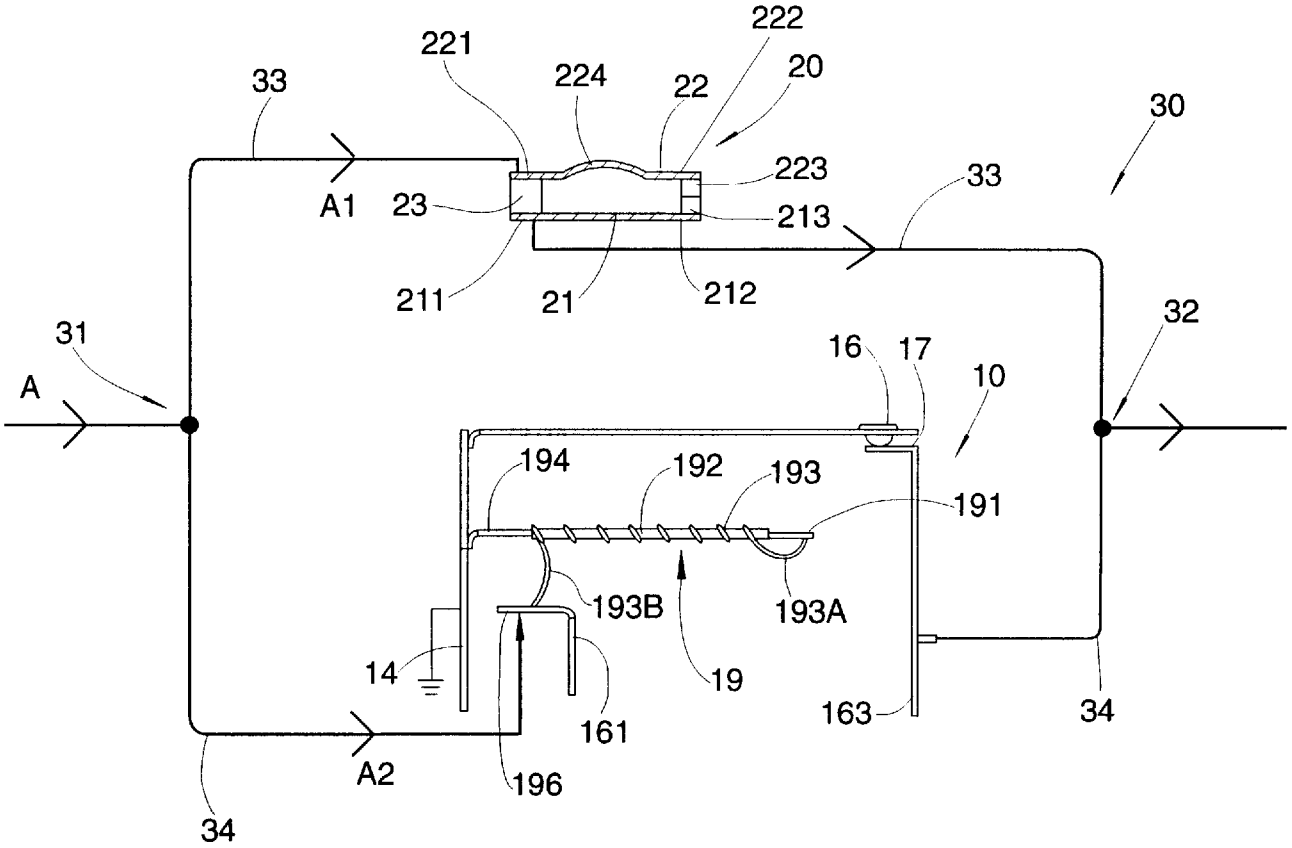
FIG. 4 is a circuit diagram illustrating the circuit connected between the thermal release actuator in the circuit breaker switch and the thermal detector, where the thermal detector is in contacted condition, according to the above preferred embodiment of the present invention.
Figure 5:
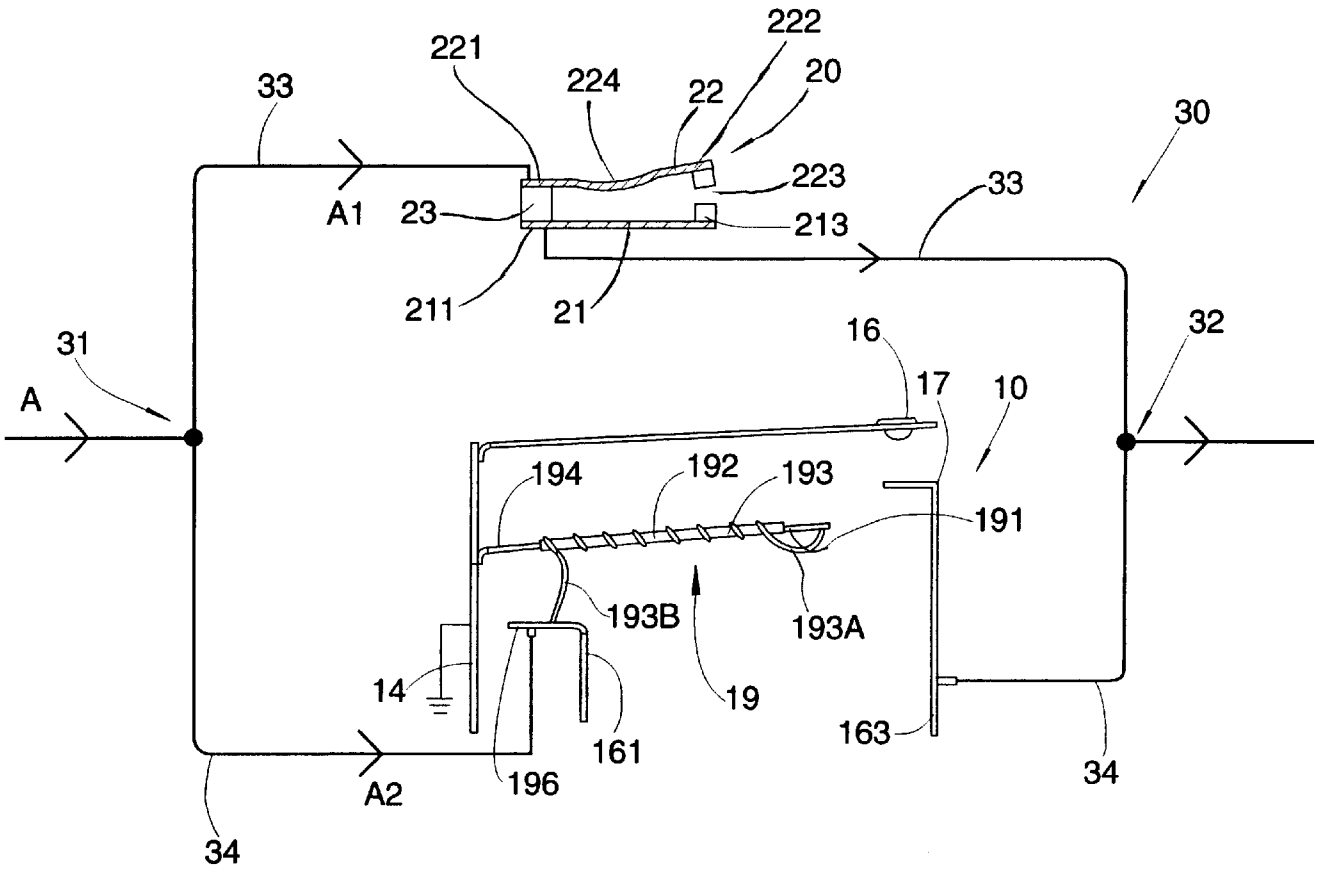
FIG. 5 is a circuit diagram illustrating the circuit connected between the thermal release actuator in the circuit breaker switch and the thermal detector, where the thermal detector is in uncontacted condition, according to the above preferred embodiment of the present invention.

As shown in FIGS. 1, 4 and 5, the thermal detector 20, which can be a thermo-regulator, is adapted for breaking a current flowing therethrough when a surrounding temperature around the thermal detector 20 changes from a normal temperature to a predetermined temperature, wherein when the surrounding temperature around the thermal detector 20 returns to the normal temperature, the current flows therethrough again.

According to the preferred embodiment, as shown in FIG. 1, the thermal detector 20 comprises a first contact member 21 made of electrical conducting material such as brass, a second contact member 22 made of thermostatic metal (bi-metal) and an insulating connector 23 connected between a connecting end 221 of the second contact member 22 and a first end 211 of the first contact member 21. A second end 212 of the first contact member 21 protrudes a first contact point 213 facing to the second contact member 22.

The second contact member 22 is normally remained in contact with the first contact member 21. The second contact member 22 has a contact end 222 which protrudes a contact point 223 normally pressed against the first contact point 213. The second contact member 22 would bend away from the first contact member 21 so as to separate from the first and second contact members 21, 22 when the surrounding temperature around the thermal detector 20, i.e. the second contact member 22, reaches a predetermined temperature. The predetermined temperature depends of the material nature of the second contact member 22. Therefore, the current flowing through the first and second contact members 21, 22 is cut off.

On the second contact member 22, a circular convex groove 224 is formed. Accordingly, when the second contact member 22 is heated by the hot surrounding, the circular convex groove 224 ensures that the contact end 222 of the second contact member 22 will bend upwardly away from the first contact member 21, as shown in FIG. 5. Moreover, the thermal detector 20 enables the first current to flow therethrough again when the surrounding temperature around the thermal detector 20 drops back to normal temperature, in which the second contact member 22 bends down to contact the first contact member 21 again.

As shown in FIGS. 4 and 5, the connecting circuit 30 is adapted to electrically connect the thermal detector 20 in parallel with the circuit breaker switch 10 comprising the thermal release actuator 19 . The connecting circuit 30 comprises an input terminal 31, an output terminal 32, a first connecting wire 33 to electrically connect the second contact member 22 and the first contact member 21 of the thermal detector 20 with the input and output terminals 31, 32 respectively, and a second connecting wire 34 which is extended between the input and output terminals 31, 32 in parallel with the first connecting wire 33 to electrically connect the second and third connecting lugs 161, 163 of the thermal release actuator 19 with the input and out put terminals 31, 32.

The circuit breaker assembly 10 is electrically connected in the control panel of a building circuit, the current release device 18 is employed in response to current overload so as to protect the circuit from excess current, wherein the occurrence of a current overload causes the bimetal strip 181 to bend upwardly and, after coming to abut against the associated projection 149 of the angular lever 135, to pivot that angular lever 135 in the pivoting direction, as shown in FIG. 2 and 3. Moreover, as shown in FIGS. 4 and 5, a main current A of the building circuit flows through the thermal detector 20 and the thermal release actuator 19 which is connected in parallel with the thermal detector 20. The main current A (for example 15 A) is divided into a first current A1 (as large as possible, e.g. 14.8 A) to flow through the thermal detector 20 and a second current A2 (as small as possible, e.g. 0.2 A) to flow through the thermal release actuator 19, as shown in FIG. 4. According to the present invention, the first current A1 must be set to have more than 50% (preferable more than 90%) of the main current A and the second current A2 is set to have less than 50% (preferable less than 10%) of the main current A.

Therefore, as shown in FIG. 4, when the second contact member 21 is normally remained in contact with the first contact member 21, the first current A1 which shares more than 50% (e.g. 14.8 A) of the main current A (e.g. 15 A) inputs at the input terminal 31 of the connecting circuit 30 and flows through the thermal detector 20. A second current A2 which is less th an 50% (e.g. 0.2 A) of the ma in current A flows through the thermal release actuator 19.

However, as shown in FIG. 5, when the second contact member 21 bends to break contact with the first contact member 21 due to the overheated or over-cooled environment around the thermal detector 20, the first connecting wire 33 breaks and the first current A1 becomes zero. Therefore, 100% of the main current A (15 A) will flow to the thermal release actuator 19 via the second connecting wire 34. In other words, the second current A2 equals to the main current A (i.e. 15 A). Due to the immediately increased of the second current A (such as from 0.2 A to 15 A), the heat wire 193 wrapped around the actuating piece 191 generates heat to increase the temperature around the actuating piece 191. When the temperature around the actuating piece 191 increases to a predetermined extent, as shown in FIG. 1, the actuating piece 191 bends upwardly so as to provide actuating action to abut against the associated projection 148 of the angular lever 135, to pivot that angular lever 135 in the pivoting direction to switch off the circuit breaker switch 10 to cut the electric supply.

Figure 6:
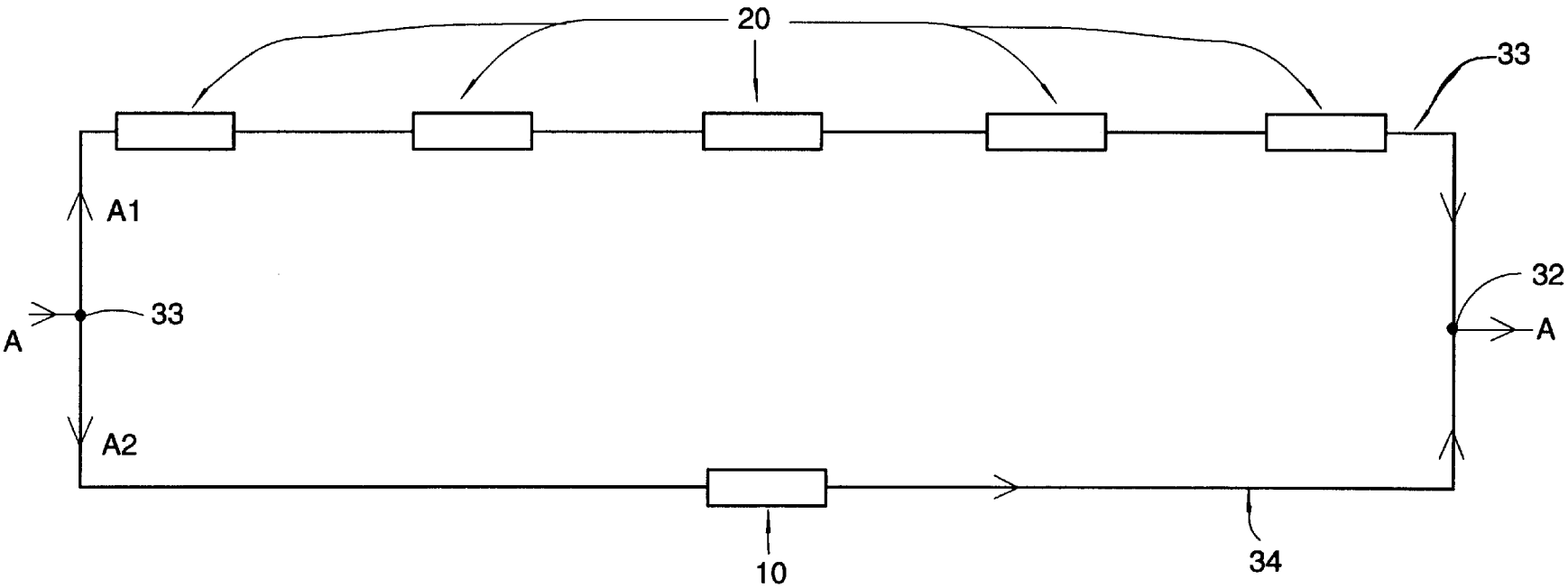
FIG. 6 is a schematic view to illustrate an alternative mode of the circuit connection between the thermal release actuator in the circuit breaker switch and a plurality of the thermal detectors according to the above preferred embodiment of the present invention.

FIG. 6 illustrates an alternative mode of operation of the present invention, wherein a plurality of thermal detectors 20 are connected in series, which are further connected in parallel with the thermal release actuator employed in a circuit breaker switch 10. The thermal detectors 20 are adapted to be installed at various heat generating areas of an electrical circuit. When any one of the thermal detectors 20 detects overheat or overcold therearound, the respective thermal detector 20 breaks the first current A1 flowing, through the first connecting wire 33. Similarly, the entire main current A flows through the thermal release actuator 19 of the circuit breaker switch 10 to provide an actuating action to switch off the circuit breaker switch 10.

The parallel arrangement of the thermal detectors 20 and the thermal release actuator 19 of the circuit breaker switch 10 enables the circuit breaker assembly of the present invention to incorporate more than one thermal detector 20 without affecting the voltage loading of the electrical circuit.

What is claimed is:

1. A circuit breaker assembly, comprising:

a thermal detector to break a first current flowing therethrough when a surrounding temperature around said thermal detector changes from a normal temperature to a predetermined temperature;

a circuit breaker switch comprising:

a housing; having walls a pair of contact springs each affixed at one end in said housing and carrying a movable contact at a free end thereof, and biased to urge said movable contact away from an associated fixed contact;

a switching rocker pivotally mounted in said housing to selectively move between a breaker closing position so as to act on said contact spring to urge said movable contact toward said fixed contact and a breaker opening position in which said switching rocker permits said contact spring to move said movable contact away from said fixed contact, said switching rocker being mounted to pivot about an axis which extends approximately perpendicular to said length of said contact spring;

a current release device arranged in said housing to be responsive to a current overload and operative to permit said respective contact spring to move said movable contact thereof away from said corresponding fixed contact upon said occurrence of a current overload and independently of said position of said switching rocker; and a thermal release actuator received in said housing to automatically provide an actuating action to operate said respective contact spring to move said movable contact thereof away from said corresponding fixed contact when said surrounding temperature around said thermal detector changes from said normal temperature to said predetermined temperature; and a connecting circuit to electrically connect said thermal detector in parallel with said thermal release actuator of said breaker switch, wherein a main current which flows through said thermal release actuator is divided into said first current flowing through said thermal detector and a second current flowing through said thermal release actuator of said circuit breaker switch.

2. A circuit breaker assembly, as recited in claim 1, wherein a pair of first connecting lugs and a pair of second connecting lugs spacedly project out of said housing and are secured tightly in said housing by being twisted, said current release device comprising a bimetal strip which is fastened to one of said first connecting lugs and connected with a bimetal strip lead of one of said second connecting lugs.

3. A circuit breaker assembly, as recited in claim 2, wherein said thermal release actuator comprises an actuating piece made of thermostatic metal (bi-metal), an insulating sleeve covering a front portion of said actuating piece, and an electrical heat wire wrapping around said insulating sleeve, wherein said electrical heat wire has a first end electrically connected to said actuating piece and a second end electrically connected to another of said second connecting lugs which is not structurally connected with said first connecting lugs and said actuating piece, said insulating sleeve acting as an insulating layer between the surface of said actuating piece and said heat wire to avoid electrical contact therebetween, a rear portion of said actuating piece being connected to said another of said first connecting lugs.

4. A circuit breaker assembly, as recited in claim 3, wherein fixed ends of said two contact springs are welded to two of said first connecting lugs respectively to form a conductive connection therewith, and each of said fixed contacts is permanently connected to a contact terminal which forms a one-piece unit with a third connecting lug which is likewise fastened in said wall of housing.

5. A circuit breaker assembly, as recited in claim 4, wherein said thermal detector comprises a first contact member made of electrical conducting material such as brass, a second contact member made of thermostatic metal (bi-metal) and an insulating connector connected between a connecting end of said second contact member and a first end of said first contact member, wherein a second end of said first contact member protrudes a first contact point facing to said second contact member.

6. A circuit breaker assembly, as recited in claim 5, wherein said second contact member is normally remained in contact with said first contact member, said second contact member having a contact end which protrudes a contact point normally pressed against said first contact point, wherein when said surrounding temperature around said thermal detector reaches said predetermined temperature, said second contact member bends away from said first contact member so as to break contact with said first and second contact members, therefore said first current flowing through said first and second contact members is cut off.

7. A circuit breaker assembly, as recited in claim 6, wherein on said second contact member, a circular convex groove is formed.

8. A circuit breaker assembly, as recited in claim 1, wherein said thermal release actuator comprises an actuating piece made of thermostatic metal, a conducting terminal piece connected to said actuating piece, an insulating sleeve covering a portion of said actuating piece, and an electrical heat wire wrapping around said insulating sleeve, wherein said electrical heat wire has a first end electrically connected to said actuating piece and a second end electrically connected to said connecting circuit.

9. A circuit breaker assembly, as recited in claim 8, wherein said thermal detector enables said first current to flow therethrough again when said surrounding temperature around said thermal detector returns to said normal temperature.

10. A circuit breaker assembly, as recited in claim 9, wherein said first current contains more than 50% of said main current and said second current contains less than 50% of said main current.

11. A circuit breaker assembly, as recited in claim 9, wherein said thermal detector comprises a first contact member made of electrical conducting material, a second contact member made of thermostatic metal and an insulating connector connected between a connecting end of said second contact member a nd said first contact member, wherein said second contact member is normally remained in contact with said first contact member, however when said surrounding temperature around said thermal detector reaches said predetermined temperature, said second contact member bends away from said first contact member to break contact with said first contact member.

12. A circuit breaker assembly, as recited in claim 10, wherein said thermal detector comprises a first contact member made of electrical conducting material, a second contact member made of thermostatic metal and an insulating connector connected between a connecting end of said second contact member and said first contact member, wherein said second contact member is normally remained in contact with said first contact member, however when said surrounding temperature around said thermal detector reaches said predetermined temperature, said second contact member bends away from said first contact member to break contact with said first contact member.

13. A circuit breaker assembly, as recited in claim 8, wherein said connecting circuit comprises an input terminal, an output terminal, a first connecting wire electrically connected to said thermal detector between said input and output terminals, and a second connecting wire which is extended between said input and output terminals in parallel with said first connecting wire so as to electrically connect said circuit breaker switch between said input and out put terminals.

14. A circuit breaker assembly, as recited in claim 11, wherein said connecting circuit comprises an input terminal, an output terminal, a first connecting wire electrically connected to said thermal detector between said input and output terminals, and a second connecting wire which is extended between said input and output terminals in parallel with said first connecting wire so as to electrically connect said circuit breaker switch between said input and out put terminals.

15. A circuit breaker assembly, as recited in claim 11, wherein an end of said first contact member protrudes a first contact point facing to said second contact member and said second contact member has a contact end which protrudes a contact point arranged to be normally in contact with said first contact point.

16. A circuit breaker assembly, as recited in claim 15, wherein on said second contact member, a circular convex groove is formed.

17. A circuit breaker assembly, as recited in claim 12, wherein an end of said first contact member protrudes a first contact point facing to said second contact member and said second contact member has a contact end which protrudes a contact point arranged to be normally in contact with said first contact point.

18. A circuit assembly, as recited in claim 17, wherein on said second contact member, a circular convex groove is formed.

19. A circuit assembly, as recited in claim 8, wherein said first current contains more than 90% of said main current and said second current contains less than 10% of said main current.

20. A circuit assembly, as recited in claim 9, wherein said first current contains more than 90% of said main current and said second current contains less than 10% of said main current.

* * * * *